United States Patent [19]

Pieri

[11] 4,293,054

[45] Oct. 6, 1981

[54] SCAFFOLDING FOR SUPPORTING LIFTING WORKING BRIDGES AND PLATFORMS

[75] Inventor: Antonio Pieri, Montebelluna, Italy

[73] Assignee: PIAT Impalcature Automatiche S.p.A., Italy

[21] Appl. No.: 150,975

[22] Filed: May 19, 1980

[51] Int. Cl.[3] ..... E04G 1/20; E04G 7/20

[52] U.S. Cl. ..... 182/63; 182/131; 182/148; 182/146

[58] Field of Search ..... 182/63, 141, 148, 146, 182/145, 223, 113, 131, 130

[56] References Cited

U.S. PATENT DOCUMENTS

| | | | |
|---|---|---|---|
| 2,904,126 | 9/1959 | Meng | 182/148 |
| 3,197,178 | 7/1965 | Nietz | 182/63 |
| 3,318,414 | 5/1967 | Meek | 182/146 |
| 3,352,380 | 11/1967 | Barney | 182/148 |
| 3,438,460 | 4/1969 | Solari | 182/146 |
| 3,516,512 | 6/1970 | Kupke | 182/141 |
| 3,548,970 | 12/1970 | Hutchens | 182/141 |
| 3,937,301 | 2/1976 | Bertail | 182/141 |
| 3,946,836 | 3/1976 | Maack | 182/141 |

FOREIGN PATENT DOCUMENTS

| | | | |
|---|---|---|---|
| 237875 | 1/1965 | Austria | 182/141 |

*Primary Examiner*—Reinaldo P. Machado
*Attorney, Agent, or Firm*—Staas & Halsey

[57] ABSTRACT

Scaffolding including at least: two posts (1), a lifting working bridge (2) and a lifting platform (3), said scaffolding being made of modular elements, connectable to each other in disassemblable manner, each post (1), which is triangular in cross section, being formed; by a base lattice element (7) which can rest on the ground selectively by means of wheels (15) or by feet (16) of adjustable height; and by other lattice elements (7*a*), each bridge (2) platform (3) having a carrying structure including; at least a carrying framework (31) supporting a motor unit (4) and a braking unit (5) mounted in correspondence of each post (1); and end lattice elements (46) and intermediate lattice elements (47*a*, 47*b*) triangular in vertical cross section, said carrying structure also supporting a front and a rear parapet (149 and 150), each made of modular elements (56), at least the parapet (150) being mounted so as to be moved to and from the other parapet (149) so as to vary the width of the walk surface (148) of the bridge (2) or platform (3).

6 Claims, 24 Drawing Figures

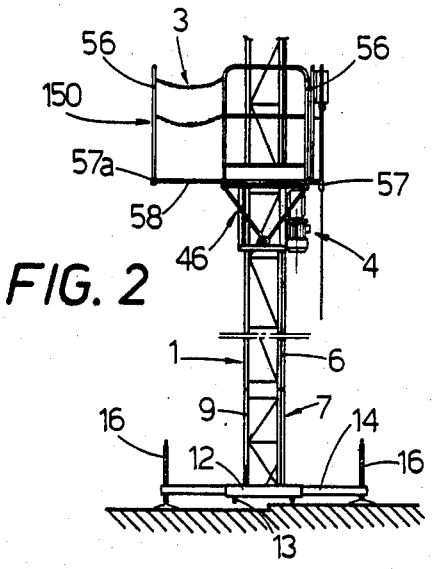
FIG. 2
FIG. 8
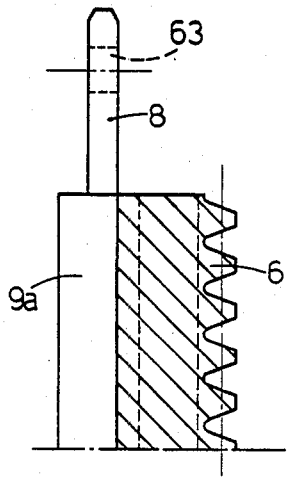
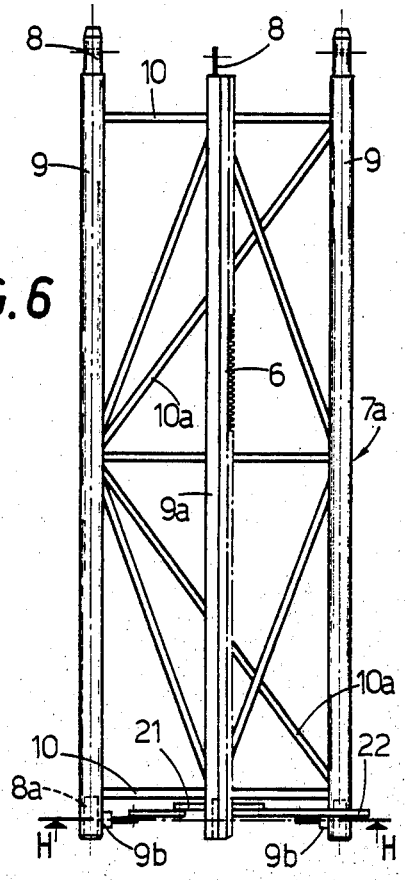
FIG. 6
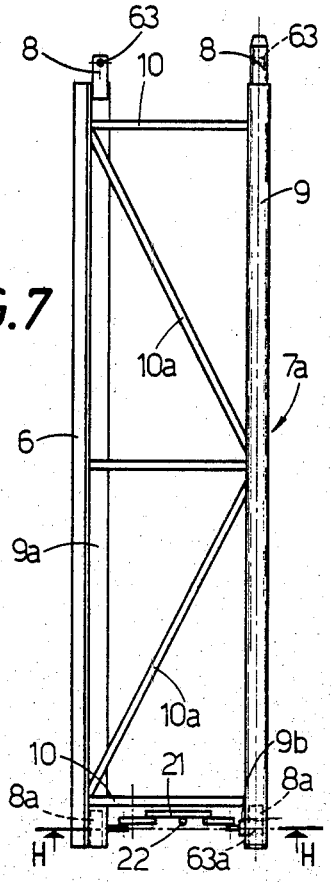
FIG. 7

FIG. 22
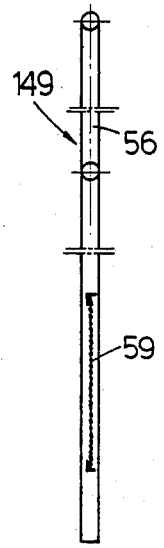
FIG. 20
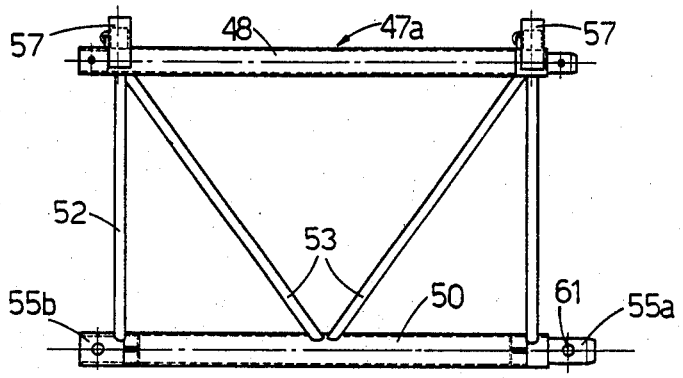
FIG. 21
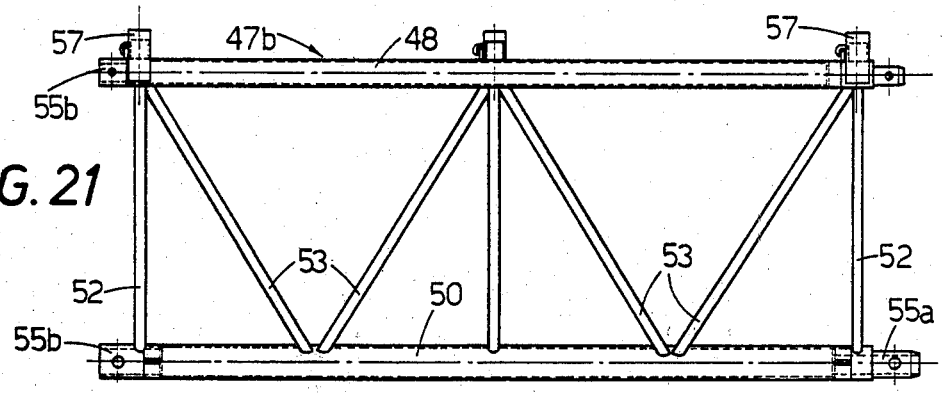
FIG. 23
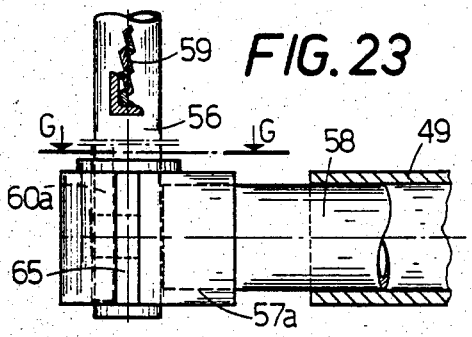
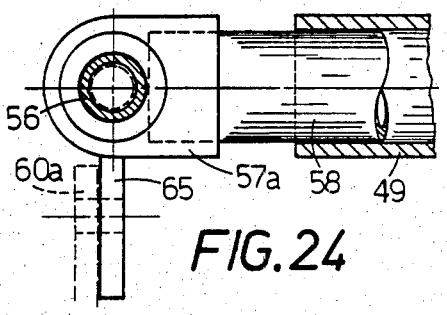
FIG. 24

SCAFFOLDING FOR SUPPORTING LIFTING WORKING BRIDGES AND PLATFORMS

BRIEF SUMMARY OF THE INVENTION

The present invention relates to a scaffolding provided with at least one lifting working bridge and/or platform made to ascend or descend along vertical guide rails mounted on lattice support posts and to be used in building constructions so as to easily perform works on the outer building surfaces at different levels and which can be also used for transferring from a level to another workmen, prefabricated goods, materials, in general, machineries of any type, as well as for moving out and transferring pieces of furniture or other apparatus of great sizes which can be very difficult to transport along the staircases.

Scaffoldings are already known supporting vertically displaceable working bridges of various types, but their installation is complicate and expensive; and, what's more, it requires the employment of skilled labour.

The present invention relates to an assemblable and disassemblable scaffolding including modular structural elements enabling to be easily connected to each other for the construction of posts or uprights for supporting the desired working or service bridge or bridges and/or the platform or platforms, each post being constituted of a plurality of lattice modular members which can be mounted and connected to each other by groove and tongue joints or other suitable releasable joint means.

One of said plurality of lattice members designed to construct a post is so shaped as to form the base element of said post and is fixed to a base frame mounted on wheels; said base frame can be in turn connected to a second base frame of greater size which is in turn supported by wheels designed to allow the transfert of the already erected post from a work spot to another. Feet of adjustable height are also provided on this second frame, designed to permit to firmly let rest the post on the ground even if this latter is not perfectly horizontal.

Other modular members are also provided for constructing the liftable service bridges and/or platforms of the desired sizes.

BRIEF DESCRIPTION OF THE DRAWINGS

These and other characteristics and advantages of this invention will be apparent upon consideration of the following description taken in consideration with the accompanying drawings, in which:

FIG. 2 is a side view of a portion of the first upright or post, positioned on the left hand, and of the platform mounted thereon, said view being taken on the line A—A of FIG. 1;

FIGS. 6 and 7 show the front view and the side view, respectively, of one of the intermediate sections of a upright or post;

FIG. 8 shows the detail, in enlarged scale, of the upper end portion of the vertical bar fixedly connected to a rack, which has been sectioned on the plane C—C of FIGS. 4 and 9;

FIGS. 20 and 21 show the front views of an intermediate simple or double lattice element, respectively, for supporting a platform or a bridge;

FIG. 22 is the cross section taken on the line E—E of FIG. 1 of the rear breastwork or parapet of the bridge;

FIG. 23 is the detail of the lower portion of a modular element for constructing a rear breastwork or parapet and shows the joint means provided to connect the parapet element to the lattice support element, mounted therebelow, of a bridge or platform by means of telescopic members; and FIG. 24 is the horizontal section taken on the line G—G of FIG. 23.

DETAILED DESCRIPTION

Figure 1:
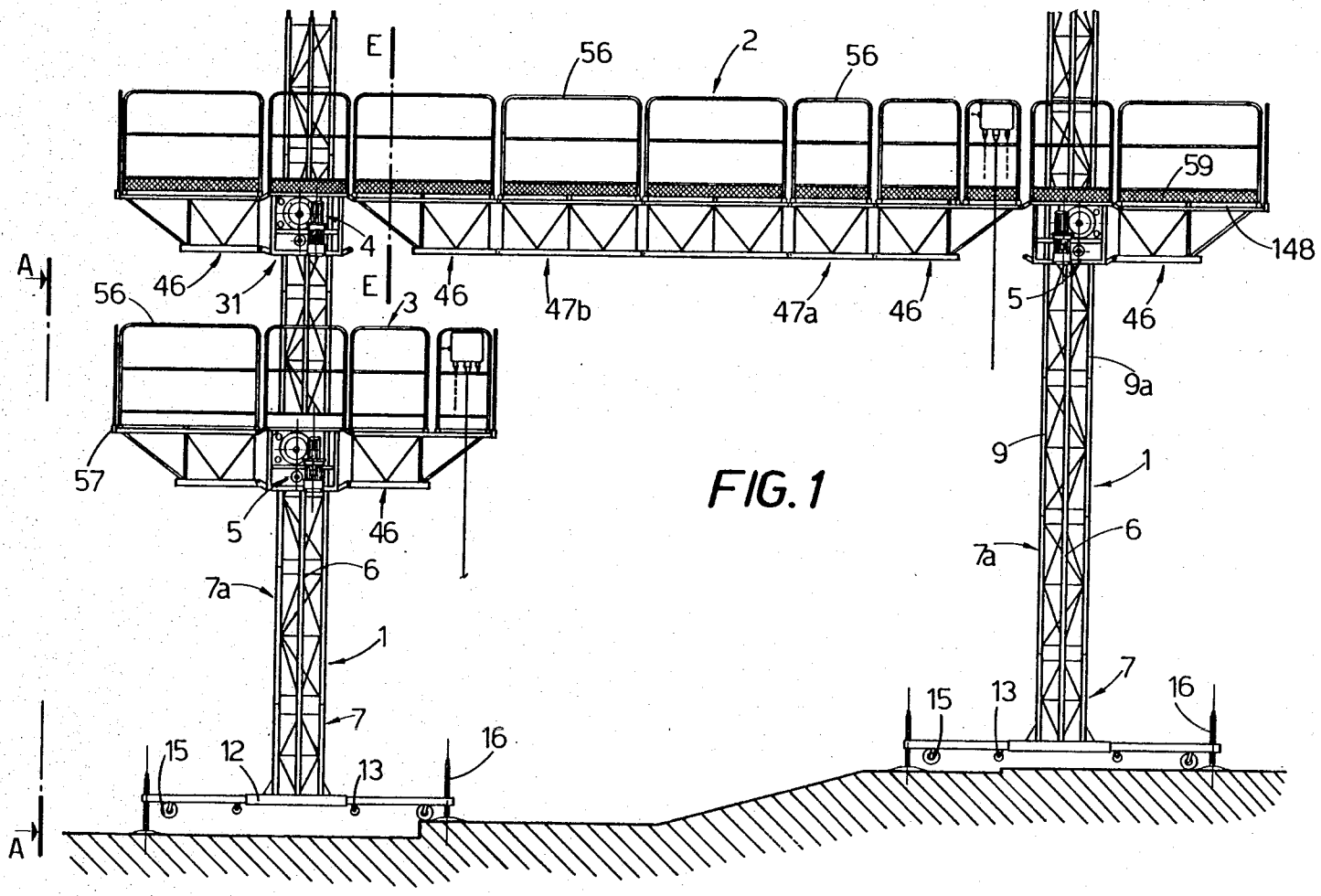
FIG. 1 is a front view of a scaffolding including two posts designed to support a working lifting bridge and a lifting platform.

Now referring in particular to FIGS. 1 and 2 of the drawings, at 1 are generally marked the lattice composite uprights or posts which serve to support at least a bridge 2 and/or a platform 3, so that said bridge 2 and/or platform 3 can be moved vertically along said posts 1 by means of the motor units, generally indicated 4, and which can be also firmly locked thereto at any required level, by means of the braking units 5, which act on the vertical toothed bars 6 supported by the posts 1. All the motor units 4 designed to move up and down a lifting bridge 2 and the respective braking units 5 operate, respectively, in unison.

Figure 3:
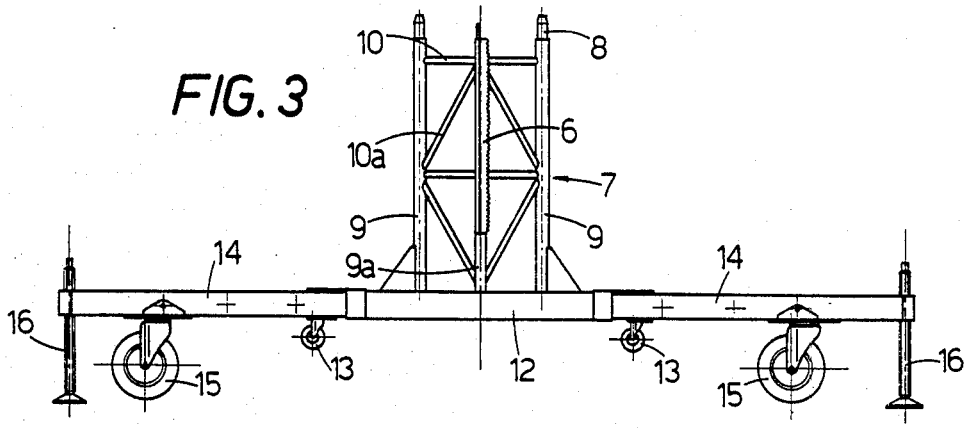
FIGS. 3 to 5 show the lowest section of a post in front view, top view and side view, respectively.
Figure 4:
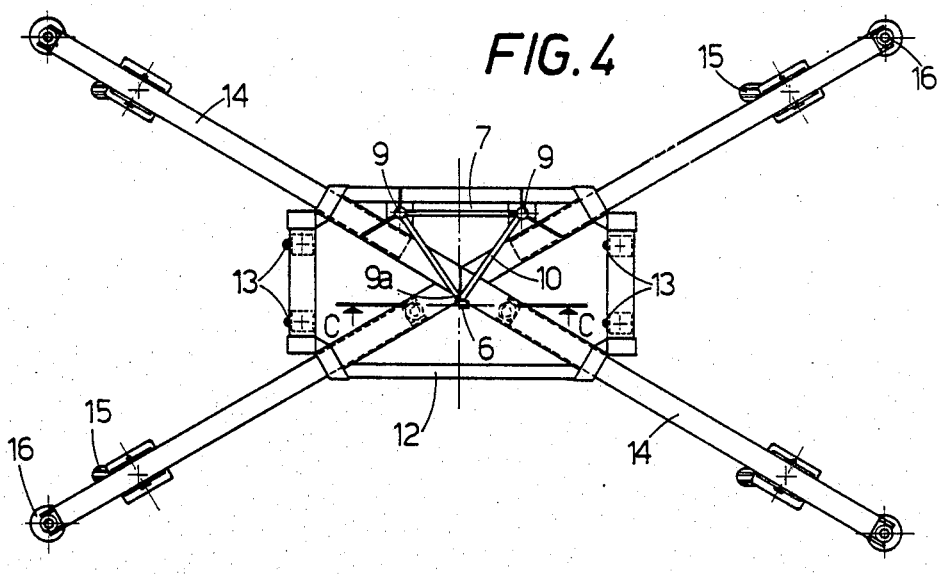
Figure 5:
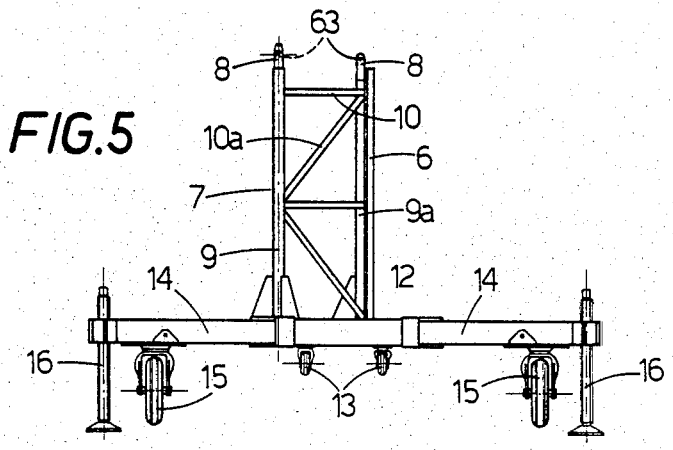

Each platform 3 is supported by a single post 1, while a bridge is supported by at least two posts 1. Each post 1 is constituted of a base lattice member 7 (FIGS. 3 to 5) and by intermediate lattice members 7*a* which can be connected to each other by end groove-and-tongue joints 8 and 8*a* or by any other equivalent suitable joining means so as to obtain uprights or posts 1 of any desired height and adapted to be easily assembled and disassembled.

Each base element 7 comprises a lattice member having a triangular cross-section and which comprises two vertical tubular rods 9 and a front vertical bar 9*a*, connected to each other by transverses 10 and sloping stiffening bars 10*a*. The lattice element 7 as well as the other superimposed lattice elements 7*a* having the same triangular cross section have the two tubular rods 9 with axes are arranged in a vertical plane which will be parallel to the longitudinal vertical centre plane of the bridge 2, i.e. parallel to the surface of the building along which the scaffolding will be erected, while the bar 9*a* will be positioned in the vertical centre plane of each upright 1, which is set at right angle to the longitudinal centre axis of the bridge 2 and said bar 9*a* will be placed so as to face towards the front of the scaffolding. To each vertical bar 9a along its outer front is fixedly connected a length of a longitudinal rack 6, so that, when all the sections 7, 7a of a post 1 have been assembled, the rack sections 6 constitute a continuous rack in which a toothed wheel 110 will be engaged driven by each motor unit 4, as well as the braking toothed shoe 11 of each braking unit 5, which cooperate with said upright or post 1.

Figure 9:
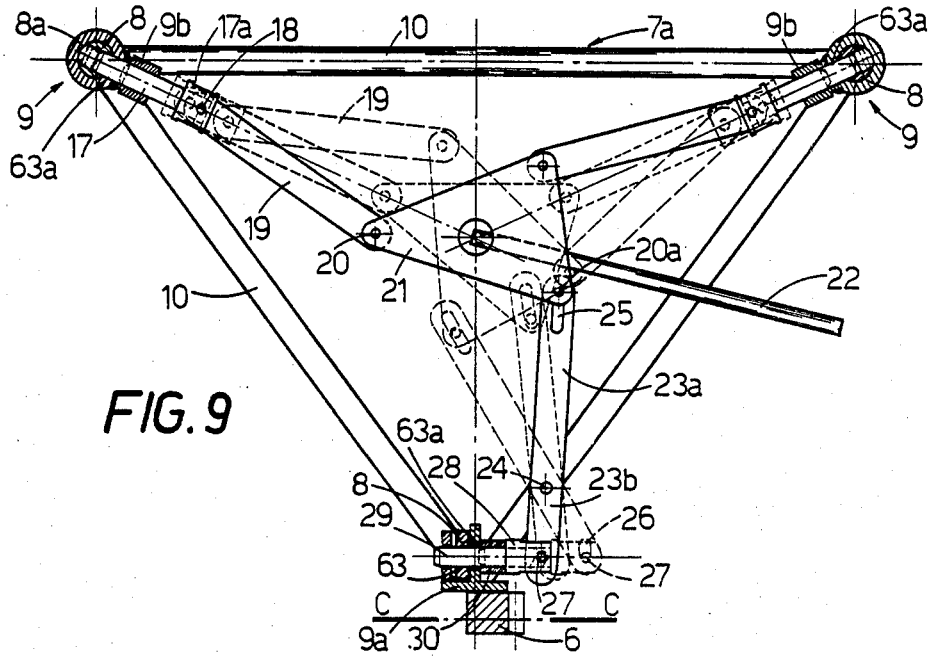
FIG. 9 is the cross view taken on line H—H of FIGS. 6 and 7 of an interme diate post section, where there is the device provided to lock the joint members connecting a pair of superimposed post sections.

Each base member 7 is made integral with a base frame 12 carried by four wheels 13; the frame 12 can be connected, by releasable means, to a main frame 14 which is wider and stronger than the frame 12 so as to be adapted to bear the weight of the whole post 1. The frame 14, in turn, is carried by strong wheels 15, while near its end portions feet 16 are mounted of adjustable height and having such a length so that, when they rest on the ground, the wheels 15 remain hanging from said frame 14, spaced apart from the ground (FIG. 1) and the post 1 can rest on the ground in a stable manner, said feet 16 being also suited to compensate for differences in height of said ground. Therefore the wheels 13 are designed to be used for permitting only an easier displacement of the base member 7 of the post 1, which is the heaviest member of each post 1, i.e. only during the assembling of the members 7, 7a for constructing a post 1, while the wheels 15 are designed to allow each assembled post 1 together with the bridge or bridges 2 and/or platform 3 supported thereby to be moved from a work spot to another. Then the feet 16 will be lowered and, as a result thereof, the wheels 15 will be displaced upwardly away from the ground so as to give to each post 1 a complete stability and a perfect verticality, whichever may be the characteristics of the ground surface. The intermediate lattice members 7a of each post 1 have the same lattice structure as the base member 7; i.e. each of them includes the components 9, 9a, 10 and 10a and the end male and female joint members 8, 8a at the ends of the tubular rods 9 and bars 9a. In order to better lock the connection between the assembled post sections 7 and 7a and more in particular the joint members 8, 8a of their corner rods 9 and bars 9a connected to the rack lengths 6, a device is provided near the end of each post member 7a, where the female joint members 8a are arranged. For such a purpose the end portions of the vertical members 9 are made each integral with a horizontal sleeve 9b which extends towards the inner area of each member 7a (FIG. 9); into each sleeve 9a can reciprocate a short rod 17, the outer end portion 17a of which is shaped as a fork which is pivotally connected about the pivot pin 18 to a connecting rod 19 which at its other end is in turn pivotally connected at 20 in close proximity of one of the angles of a horizontal triangular central plate 21, to the centre portion of this latter is fixed a control arm 22 extending out of plate 21 and out of the post member 7a. Near the remaining angle of the plate 21 a pivot pin 20a is provided which connects said plate 21 to a lever arm 23a, said pin 20a being engaged into a longitudinal guide slot 25 provided at the outer end of the arm 23a of a lever which is pivotally connected at 24 to a connecting bar 10 of the element 7a, while the other arm 23b of the lever is connected through a connection comprising a longitudinal guide slot 26 and a pin 27 to a fork 28 made integral with a pin 29 reciprocating inside a guide sleeve 30 made integral with the bar section 9a which carries a rack length 6. This locking device has been not shown in the diagrammatic FIGS. 1 and 2 for clarity reason. This device is shown in FIG. 9 in full lines in one of their intermediate positions and it can pass from its inoperative position, shown in dotted lines in said FIG. 9, to the position of greatest spreading condition, shown in broken lines, and in which the device causes the stiffening and a surety locking of the vertical rods 9 and those of the bars 9a of each post 1, since the outer ends of the pins 17 are forced so as to be pushed outwardly at the most and enter through the holes 63 and 63a arranged through the ends of the rods 9, 9a where the joint members 8 and 8a are provided.

Figure 12:
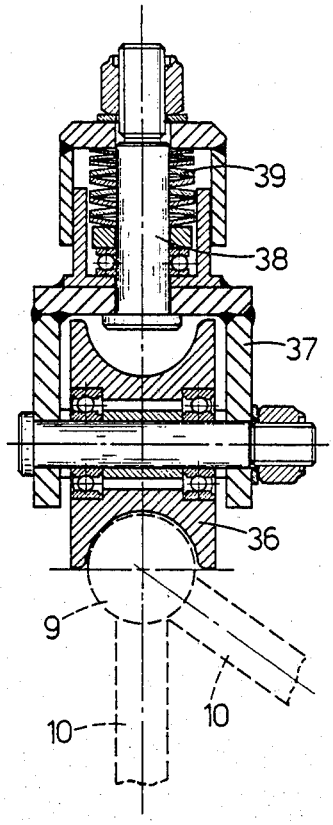
FIG. 12 is a detail, in enlarged scale, of the section taken on the line D—D of FIG. 10.
Figure 11:
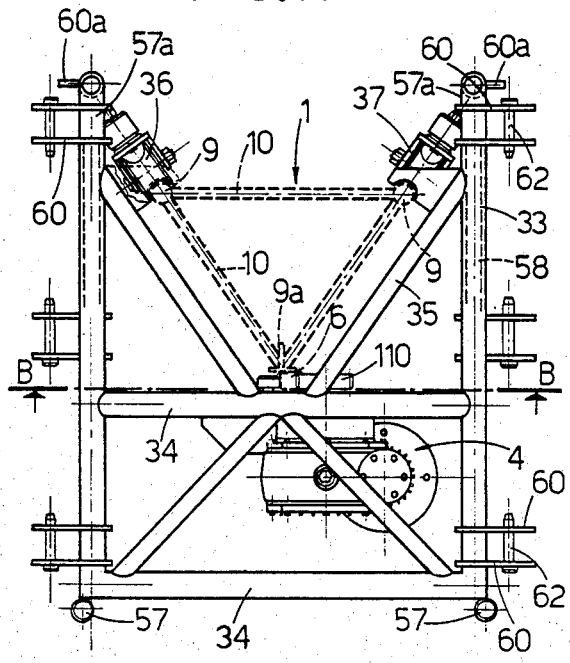
Figure 13:
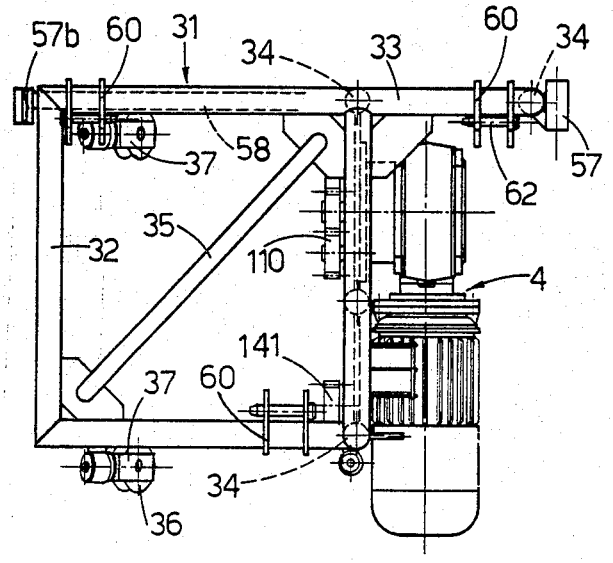
FIGS. 13 and 14 show a side view and the cross view taken on the line B—B of FIG. 11, respectively, of the framework supporting the motor unit and the braking unit.

Each working bridge 2 can slide up and down along at least two posts 1 and each platform 3 along one post 1. For such a purpose each platform 3 or bridge 2 in correspondence of each post 1 comprises a prismatic framework generally indicated 31, which consists of vertical tubular members 32 and horizontal tubolar connecting beams 33 set at right angles to the vertical centre plane of the bridge 2 or of the platform 3 connected thereto, as well as of horizontal beams 34 parallel to said plane, three of said beams 34 being positioned in the front of each framework 31 and one is positioned in an intermediate position in the inside of said framework 31, while no horizontal beam 34 there is on the rear part of said framework 31 so as to form in the framework a space through which passes the associated post 1 (shown in broken lines in FIG. 11). The framework 31 is also stiffened by substantially diagonal beams 35. On the side of each framework 31 facing the surface of the building along which the work has to be carried out, pairs of guide wheels 36 are supported by the vertical members 32 of the framework 31, said wheels 36 being designed to slide along the corner rods 9 of each post 1 and being supported by fork arms 37, each of which extends towards the respective member 32 with an axial rod 38, put under the action of a series of tapered compression springs 39 (FIG. 12), said springs tending to elastically press the end of the rod 38 together with the wheel 36, carried thereby, against the facing tubular rod 9 of the post 1.

Near the upper front portion of each framework 31 is mounted the motor unit 4 of a well known type and which comprises an electric motor connected to a gearbox and to a reversing gear, which, through a suitable transmission causes the rotation of the toothed wheel 110 (FIG. 11) which is mantained always in engaged relationship with the rack 6, mounted along the vertical bar 9a of each post 1. This transmission system will not be furtherly described in detail, since it is well known in the art.

Figure 15:
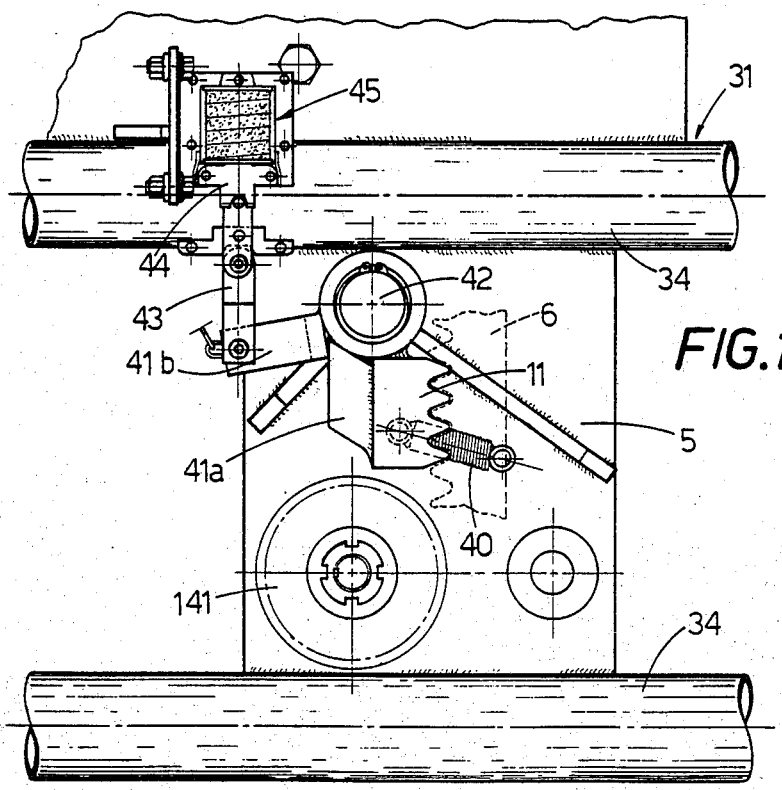
FIGS. 15 and 16 show a front view and a side view, respectively, of the detail of a braking unit.
Figure 10:
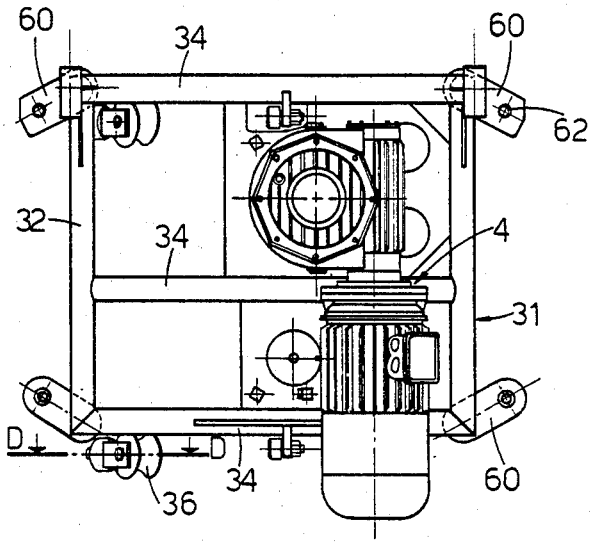
FIGS. 10 and 11 show the front view and the top view, respectively, of each framework supporting the motor unit and the braking unit.
Figure 16:
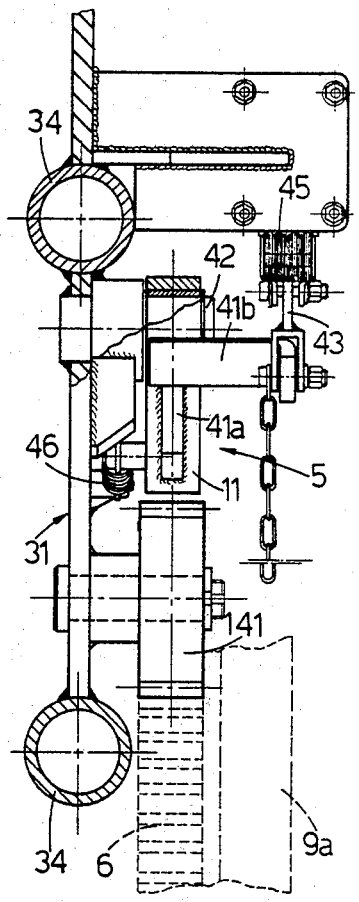
Figure 14:
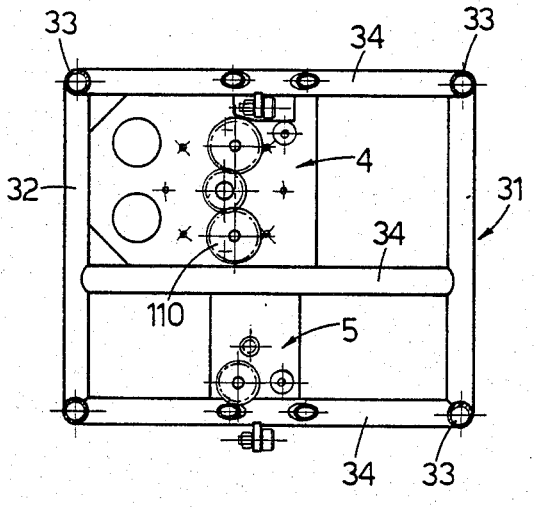

Underneath the motor unit 4 is mounted the braking unit 5 which is also "per se" well known in its operative principle, but according to this invention (FIGS. 14 and 15) it comprises a braking member 11 constituted of a toothed body or shoe mounted at the end of the arm 41a of a bell-crank lever pivotally mounted about a pin 42 supported by the framework 31, the other arm 41b of said lever being connected through a connecting rod 43 to the movable armature 44 of an electromagnet 45, a strong spring 40 (FIG. 15) tending to maintain the toothed shoe 11 engaged into the rack 6 so that said braking shoe 11 normally lockes the respective support framework 31 together with all the parts connected thereto to the respective post 1, until the electromagnet 45 will be energized. Only in this latter condition the bridge 2 and the platform 3 can be moved up or down. At 141 (FIG. 16) is indicated an idle pulley supported by the framework 31 to be moved up or down along the rack 6 of the post 1 cooperating therewith. Each framework 31 is also provided at its ends, with pairs of stirrups 60 having aligned holes to receive pins 62 for the connection of each framework 31 with the other lattice carrying elements of a bridge 2 or platform, which will be hereinafter described. The present invention also provides that each movable bridge 2 or platform 3 is constructed by modular carrying members and parapet members, and also that the surface 148 of the bridge 2 or platform 3 has an adjustable width.

Figure 17:
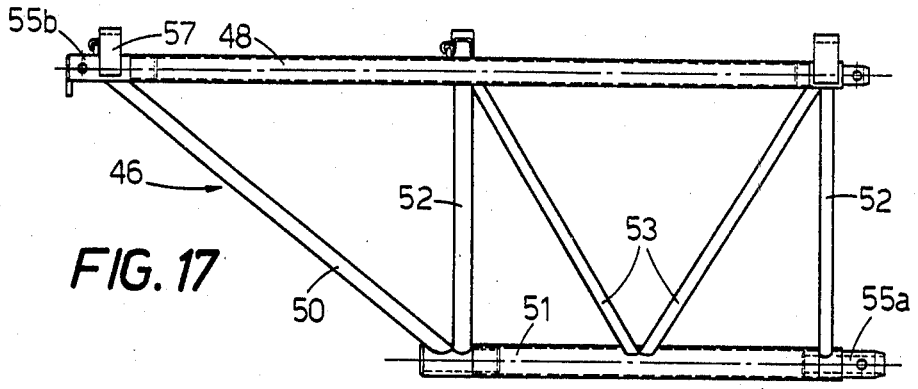
FIGS. 17 and 18 show one of the end lattice members for supporting a platform or a bridge.
Figure 18:
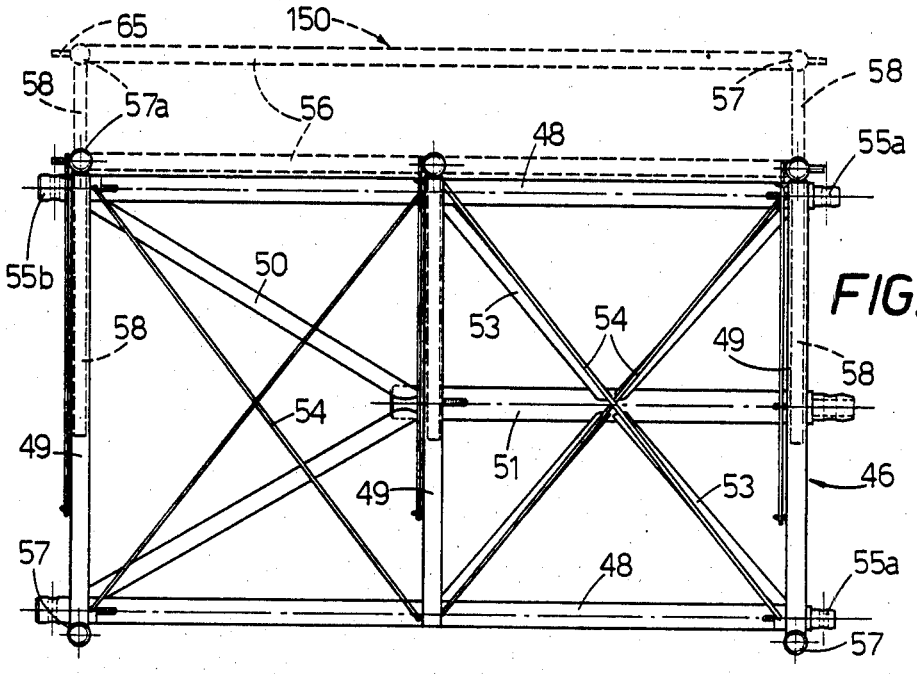
Figure 19:
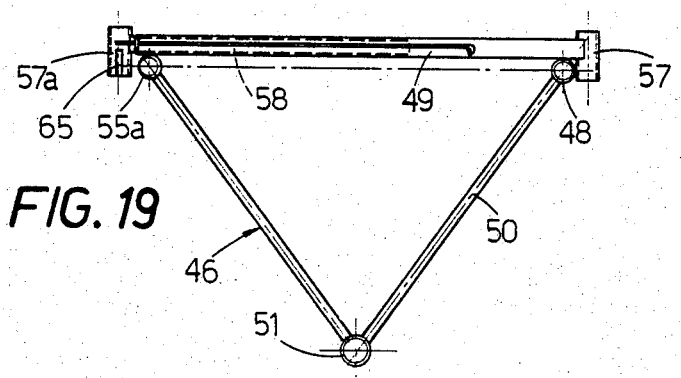
FIG. 19 shows the end view of the outer cantilever end of the lattice member shown in FIGS. 17 and 18.

The carrying members of the bridge 2 or of the platform 3 comprise: end lattice elements, generally indicated 46 (FIGS. 17 to 19), and simple and double intermediate lattice elements 47*a* (FIG. 20) and 47*b* (FIG. 21), respectively, all made of tubular members. Each of the end elements 46 comprises a rectangular upper frame, formed by longitudinal members 48 and by tubolar cross beams 49, this frame being supported at its outer end by cantilever inclined beams 50 connected at their upper ends with the beams 49, while at their lower ends these beams 50 are connected with a central longitudinal tubular member 51 which is connected to the longitudinal members 48 by means of pairs of inclined beams 52, each pair being positioned in a plane perpendicular to the axes of said longitudinal members 48. Further the tubular member 51 is connected with the upper longitudinal members 49 by inclined diagonal beams 53; diagonal tie rods 54 are also provided for stiffening the carrying member 46. At the end of the longitudinal members 48 and 51, opposite to that forming the cantilever portion of the carrying element 46 male joint means 55*a* are provided designed to engage cooperating female joint means 55*b* mounted at one of the ends of the members 47*a*, 47*b*, while, at the opposite end female joints 55*b* provided for the same purpose. Thus each structural element 46 has a cantilever portion in the form of a truncated pyramid, having a rectangular upper base and the apex positioned at the outer end of the longitudinal member 51, and a second portion of a vertical cross section in the form of an isosceles triangle with its base placed at its upper part. The simple or double members 47*a* and 47*b*, respectively, have a structure substantially identical to the lattice structure of the said second portion of each carrying member 46 so that like references indicate the parts having equivalent functions; the only difference consists in the fact that each member 47*b* can be considered equal to two members 47*a*, coupled in aligned relationship. Near the ends of the lattice elements 46, 47*a*, 47*b* holes 61 are provided to receive pivot pins 62 for locking the joint members 55*a*, 55*b* of adjacent elements 47 47*a*, 47*b* to one another or to connect the joint members of said elements through stirrups 60 to the adjacent frameworks 31.

For instance, in the embodiment shown in FIG. 1, the platform 3 is composed by two members 46 symmetrically positioned with respect of the post 1 and connected to a frame 31, which forms part of said platform 3, while the bridge 2 is formed by four end lattice elements 46, two elements 47*b*, one element 47*a*, and two framework 31, the elements 46 being respectively connected to a framework 31, which is designed to slide along one of the two posts 1. Of course, on the so composed structure of a bridge 2 or of a platform 3 a floor 148 will be then mounted, made of any suitable material, as for instance, wood boards. At 56 are generally indicated modular elements provided to form a fixed parapet 149 and a displaceable parapet 150, respectively, this latter facing the building front surface, each modular parapet element 56 of the parapets 149 or 150 comprising a vertical tubular frame having the shape of an inverted U. The parapet elements 56 have lengths corresponding to those of the carrying elements 46, 47*a*, 47*b* and 31 designed to form the bridge 2 or the platform 3, to which said elements 56 of the parapets 149 and 150 will be connected. For such a purpose along the longitudinal front side of the carrying elements 46, 47*a*, 47*b* and 31 bodies 57 are fixed into which vertical tubolar seats are arranged to receive the lower end portions of the posts of the frames 56 mounted on the front side of the bridge 2 or platform 3. On the contrary, on the rear side of the carrying elements 46, 47*a*, 47*b* and 31, each of the vertical seats is obtained in a body 57*a* having one end connected to the end of a rod 58, designed to be telescopically received into the tubolar inner space of a beam 49 or respectively 33, so that the inner parapet 150 can be moved to and from the building surface (FIGS. 2 and 18) so has to obtain a bridge 2 or platform 3 of any desired width so that the workmen can work at the more convenable distance from the building surface. At the other end of each body 57*a* is provided a braket 65 with a hole arranged to receive the pin 62 of a stirrup 60*a* provided to connect the parapet elements of the other carrying elements 46, 47*a*, 47*b* and 31. Of course, locking means or other suitable devices (not shown in the drawings) will be provided to lock the tubular elements 49 and 58 to one another, i.e. to fix the parapet 150 in the desired position.

At least the lower portion of the parapet elements 56 comprises a protection band 59, made of a wire screen or the like, provided for avoiding any fall of materials or tools from the bridge 2 or platform 3.

What is claimed is:

1. A disassemblable scaffolding for supporting lifting working bridges and platforms comprising uprights or posts and at least one lift bridge or platform which can be let ascend or descend along said posts, each bridge including at least two carrying frameworks and each platform including one carrying framework, each framework supporting a motor unit and a braking unit, said motor units serving to move the respective bridge or the platform up and down along a respective post and the braking units serving to the locking thereof at any desired level, characterized by the fact that the scaffolding is constituted of modular elements which can be assembled to each other by means of releasable joint means, each post (1) having a lattice structure and being formed; by a base section (7) made integral with a first base frame (12) mounted on wheels (13), and this first base frame (12) being mounted on and connected, in disasseblable manner, to a wider second frame (14) provided with other wheels (15) and with feet (15) of adjustable height, so that each post (1) and the parts connected thereto and supported thereby can selectively let slide along the ground or respectively rest stably thereon; by a plurality of other post sections (7*a*) to be mounted in superimposed relationship on the base section (7*a*), said post seconds (7, 7*a*) being triangular in horizontal cross section and including a vertical corner bar 9*a* and two tubular corner vertical rods (9) forming in their assembled condition vertical guide rails for engaging sliding guide wheels (36) supported by respective frameworks (31), forming a part of the carrying structure of each bridge (2) or platform (3), this carrying structure also comprising modular lattice carrying elements (46, 47*a*, 47*b*) connectable to each other in longitudinal alignment, each carrying structure supporting a footplane (148), as well as a front (149) and a rear parapet (150), each parapet (149 or 150) being constituted of frames (56), the frames (56) forming each front parapet (149) being connected to the carrying elements (46, 47*a*, 47*b* and 31) by means of joints comprising tubular seats designed to receive the lower ends of the posts of the frames (56), and arranged in bodies (57) fixed to the carrying structure close upper longitudinal front edges of the elements (46, 47*a*, 47*b*, 31) while the frames (56) forming the parapet (150) designed to face the building is connected to the elements (46, 47*a*, 47*b*, 31) by joints comprising tubular seats arranged into bodies (57*a*) connected to the opposite upper longitudinal edges of said elements with the interposition of telescopic connections so as to allow to vary the distance of each parapets (150) from the building and as result thereof, the width of each bridge (3) or platform (2), each post element (7*a*) comprising a device for contemporaneansly inserting surety locking pins (17 and 29) through the female and male joint members (8 and 8*a*) connecting the post menbers (7 and 7*a*).

2. A scaffolding according to claim 1, wherein each post (1) is composed of a base section (7) and of other post sections (7*a*), each post section (7, 7*a*) comprising a lattice structure including a pair of vertical corner tubular rod lenghts (9) positioned parallelely to the vertical centre plane of the bridge and facing the building surface, while the bar (9*a*) is positioned on the front side of each post (1) and is made integral with a longitudinal rack section (6), all the rack sections 6 of a post (1) forming a vertical continuous rack into which the driving toothed wheel (110) is engaged which is actuated by the motor unit (4) mounted on the support framework (31) of a bridge (2) or platform (3) associated with the posst (1), the rods (9, 9*a*) of each post length being connected to each other by horizontal or diagonal bracing stiffening bars (10 and 10*a*), each framework (31) comprising pairs of stirrups (60) for its connection with the adjacent lattice elements (46, 47*a*, 47*b*), said stirrups extending out of the end sides of each framework (31).

3. A scaffolding according to claim 1, wherein each post section (7*a*) comprises a mechanism for a surety locking of the connections of the rods (9, 9*a*) composing each post (1), said mechanism being mounted in each post section (7*a*) at the level of the female end joint members (8*a*) and consists of a triangular horizontal plate (21) mounted at the center of each post section (7*a*) and made integral with a manually operable control bar (22) for causing this plate (21) to rotate about a vertical pivot central axis, near two of the angles of said plate (21) being pivotally connected the ends of two horizontal connecting rods (19) causing the reciprocation of two respective pins (17), each reciprocating into a sleve (9*b*) extending towards said center axis from the end portion of each rod (9), each pin (17) being designed to enter through aligned holes (63, 63*a*) arranged in the male and female joints members (8, 8*a*) while at the remaining angle of the plate (21) a device is provided, which through a pin and slot connection (20*a*, 25) and a lever (23*a*, 23*b*) connected to a pivot pin (24), actuates a pin (29) which enters the aligned holes (63 63*a*) arranged through the male and female joint members (8, 8*a*) of the adjacent vertical rod sections thus the rotation of the control arm (22) causes the rotation about the center axis of the plate (21) and the contemporaneous, displacing outwardly of the locking pins (17 and 9), thus locking the joints (8, 8*a*) provided at the ends of the corner rods and bars (9, 9*a*) of each post (1).

4. A scaffolding according to claim 1, wherein each braking unit (5) includes a toothed brake shoe (11) supported by an angled lever (41*a*, 41*b*) pivotally supported by the framework (31), said shoe (11) being put under the effect of a strong spring (40), tending to press the shoe (11) to engage the rack (6) in a mutual locking condition, said shoe (11) being moved away from said engagement position by means of an electromagnet (45), the armature of which causes the lever (41*a*, 41*b*) to be moved in the opposite direction with respect of that of the operative action of said spring (40).

5. A scaffolding according to claim (1), wherein the carrying structure of each bridge (2) or platform (3) is constituted of modular lattice elements comprising:- frameworks or frameworks (31); end elements (46) having a upper horizontal frame supported at its outer end by a cantilever lattice frame and in the remaining portion by a lattice frame, triangular in vertical cross section; intermediate modular carrying elements of simple (47*a*), or double length (47*a*), each supporting a upper horizontal frame and triangular in vertical cross section, as the second portion of the elements (46), each of the lattice elements (46, 47*a*, 47*b*) having at one of their ends male joint connections (55a), and at the other end the other female joint connections (55*b*), the joints (55*a*, 55*b*) enabling the elements (46, 47*a*, 47,) to be connected to each other in aligned relationship.

6. A scaffolding according to claim 1, wherein each bridge (2) or platform (3) has a front and a rear parapet (149 and 150), constituted of modular elements, each comprising an inverted U shaped tubular frame (56) having at least one longitudinal stiffening bar, between the vertical posts of each frame (56) being mounted a protection wired band (59), the lower ends of the posts of said frame (56) being received into joint seats which are arranged in joint bodies (57) which are fixed to the front upper longitudinal sides of the carrying elements (46, 47, 47*a* and 31), while at the opposite side, the joint bodies (57*a*) are supported by the elements (46, 47*a*, 47*b* and 31) through telescopical connection means (58 and 49) having an adjustable length in the direction perpendicular to the longitudinal center axis of each bridge (2) or platform (3), on the outer longitudinal side of the end bodies 57*a* of each elements 46, 47*a*, 47*b* a bored braked 65 projects provided for the connection with a stirrup 60*a* of the parapet elements 56 of a framework 31 or of the other elements (46, 47*a*, 47*b*).

* * * * *